US008136264B2

(12) United States Patent
Bae et al.

(10) Patent No.: US 8,136,264 B2
(45) Date of Patent: Mar. 20, 2012

(54) METHOD FOR CONTROLLING AUTOMATICALLY DRYNESS

(75) Inventors: Sun Cheol Bae, Masan-Si (KR); Dae Woong Kim, Changwon-si (KR); Chang Woo Son, Busan (KR)

(73) Assignee: LG Electronics Inc., Seoul (KR)

( * ) Notice: Subject to any disclaimer, the term of this patent is extended or adjusted under 35 U.S.C. 154(b) by 1116 days.

(21) Appl. No.: 11/660,208

(22) PCT Filed: Aug. 18, 2004

(86) PCT No.: PCT/KR2004/002074

§ 371 (c)(1),
(2), (4) Date: Dec. 20, 2007

(87) PCT Pub. No.: WO2006/019200

PCT Pub. Date: Feb. 23, 2006

(65) Prior Publication Data

US 2008/0092403 A1 Apr. 24, 2008

(51) Int. Cl.
*F26B 3/02* (2006.01)

(52) U.S. Cl. ..... 34/381; 34/413; 34/497; 68/12.02; 8/159

(58) Field of Classification Search ..... 34/380, 34/381, 413, 497, 524, 526, 90, 595; 8/159; 68/12.02

See application file for complete search history.

(56) References Cited

U.S. PATENT DOCUMENTS

| | | | | |
|---|---|---|---|---|
| 3,363,326 | A * | 1/1968 | Weeks | 34/528 |
| 4,485,566 | A | 12/1984 | Vivares | |
| 4,640,022 | A | 2/1987 | Suzuki et al. | |
| 5,544,428 | A | 8/1996 | Kuroda et al. | |
| 2008/0092403 | A1 * | 4/2008 | Bae et al. | 34/487 |

FOREIGN PATENT DOCUMENTS

| | | |
|---|---|---|
| DE | 29 17 230 | 11/1979 |
| DE | 4442250 | 5/1996 |
| KR | 10-2004-0101062 A | 12/2004 |
| KR | 10-2005-0069371 A | 7/2005 |
| KR | 10-2005-0111135 A | 11/2005 |

OTHER PUBLICATIONS

Korean Notice of Allowance dated Jan. 29, 2008 issued in Application No. 10-2007-7003669 (with translation).

* cited by examiner

*Primary Examiner* — Stephen M. Gravini
(74) *Attorney, Agent, or Firm* — KED & Associates LLP

(57) ABSTRACT

An automatic dry control method is disclosed, enabling exact drying by stabilizing a detection value of a temperature sensor and performing an additional drying according to a first dryness achieving point at an automatic drying washer and a drum type dryer that determines dryness by using the temperature sensor.

18 Claims, 10 Drawing Sheets

METHOD FOR CONTROLLING AUTOMATICALLY DRYNESS

TECHNICAL FIELD

The present invention relates to an automatic washer and a drum dryer for determining dryness by using a temperature sensor, and more particularly, to a controlling method for automatically drying for drying exactly by stabling detected value of the temperature sensor and carrying out additional drying according to a point of performing a first drying.

BACKGROUND ART

In general, washing of a drum washer is performed by friction between a drum and laundry rotated by a rotary force of a motor in a state that a detergent, wash water and laundry are thrown in the drum. The washing method has an effect of generating less damage to laundry, untangling laundry, and washing by rubbing.

Demand of a combination dryer and washer is increasing, the combination dryer and washer for performing not only washing and dehydrating, but also drying laundry.

The combination dryer and drum washer forcibly draws and heats outside air from a fan and a heater provided at outside of a tub, so as to dry laundry by blowing the heated air at a high temperature into the tub.

A drum type dryer attracts attention, not as a combination washer and dryer, enabling to dry a large amount of clothes for a short period of time at one time by performing drying only.

Hereinafter, an automatic drying apparatus applied to a combination automatic dryer and drum washer of related art is described as follows. FIG. 1 illustrates an example of a location of a temperature sensor used for determining dryness at the automatic dryer and drum washer.

Generally, a drum washer of related art employed a manual dry system, wherein a user selects a drying mode for setting a proper drying time according to a load of laundry.

However, the manual dry system does not meet the users satisfaction because drying operation is not exactly performed such that laundry is less or over dried.

For solving the problem, as illustrated in FIG. 1, a drying method is developed, performing drying operation by detecting a temperature in a tub 11 and a duct 12 by means of a tub temperature sensor (Ttub) provided in the tub 11 for detecting temperature of the inside of the tub, and a duct temperature sensor (TA1) provided in the duct 12 for detecting the temperature of the duct 12, and determining dryness according to a difference (T) of the detected Ttub and TA1.

FIG. 2 illustrates a graph showing a temperature change of the duct temperature sensor and the tub temperature sensor according to the drying operation, and FIG. 3 illustrates a graph showing a change of difference between the duct temperature sensor and the tub temperature sensor.

In a condensing dry method, laundry is dried by repeating a process of drawing high temperature and low humidity air into the tub, and passing the high temperature and low humidity air through the duct such that the air drawn into the tub absorbs humidity from laundry and changes into high temperature and high humidity air by the condensing process.

In this case, the air changed into low temperature and low humidity air by the condensing process is changed into high temperature and low humidity air by a heater and is drawn back into the tub.

In the drying process, the temperature change of the tub temperature sensor (Ttub) and the duct temperature sensor (TA1) is as follows.

First, as illustrated in FIG. 2, in a first stage of drying process, since laundry in the tub contains a large amount of humidity, there is few temperature difference detected by the tub temperature sensor (Ttub) and the duct temperature sensor (TA1) because low temperature and low humidity air passes through the duct and a small amount of coolant and condensed water are collected on a lower end of the duct at a low temperature.

In a middle stage of drying process, high temperature air heated by the heater is continuously drawn for removing-humidity contained in laundry, and the temperature of the tub is continuously increased. Since the high temperature and high humidity air passes through the duct and is actively condensed, the temperatures detected by the tub temperature sensor (Ttub) and the duct temperature sensor (TA1) gradually increase by the same amount.

In a terminal stage of drying process, since the humidity contained in laundry is mostly removed and the high temperature and low humidity air passes through the duct, the temperature detected by the duct temperature sensor (TA1) is increased. In this state, since dryness of the laundry is high, the temperature detected by the tub temperature sensor (Ttub) is gradually decreased because the amount of condensed water is decreased and that of the coolant is increased.

Drying operation is divided into levels of Damp dry, Dry, and Strong dry by using the temperature difference value ($\Delta T$) as a dryness determination value $\Delta$. According to the level, drying is performed.

However, as abovementioned, the drying method of using the difference between the temperature in the tub and the temperature in the duct has problems as follows. The related art indirectly checks humidity in the washing tub by using the temperature sensor for performing an automatic drying algorithm. In other words, an estimated humidity is calculated by the temperature detection value by the temperature sensor in the duct or the tub. In other words, during the drying process, a degree of dryness is determined by calculating an average of data detected by the temperature sensor in a particular section. Accordingly, stability of data is lowered because a rotation period of a main motor rotating in first and second directions for driving the drum, a water supply period, and a drainage period are different from each other, and the periods are not consistent with a period of calculating the average value of the data.

It is noticed that the rotation period of the motor rotating in first and second directions and a point, when the temperature data is shaken, are consistent as shown in FIG. 4*b* illustrating an exploded view of (A) section of FIG. 4*a* showing temperature difference value of the duct temperature sensor and the tub temperature sensor in accordance with the drying operation.

FIG. 4*b* illustrates a graph showing a relationship between a motor period (CW_CCW) and temperature data. Waving of the temperature data makes it difficult to determine dryness exactly, thereby lowering reliability of automatic drying.

Since the method of drying by using the temperature difference between the temperature in the tub and the temperature in the duct uses a fixed dryness determination value, a passage structure is changed and it is difficult to perform drying exactly due to a location of the temperature sensor in the tub, deviation in the temperature sensor itself, deviation of the duct structure, and deviation of the heater performance.

Particularly, as illustrated in FIG. 5, when the fixed dryness determination value is used, it is difficult to perform the drying operation exactly because dryness is not determined consistently for all weights.

FIG. 5 illustrates a graph showing a change of the dryness determination value (A) at a point of achieving desired dryness according to weight.

For example, during drying operation for achieving 90% of dryness, if drying operation is performed when the dryness fixed value is set at '50', the dryness value (Δ) at the point of achieving 90% of dryness differs according to the weight.

In other words, if the dryness determination value (Δ) is '25' when the weight is 1 kg, it becomes '40' for 2 kg, and '55' for 4 kg, thus the automatic dryness detection is not exactly carried out.

In this case, the dryness determination value (Δ) is ADC decimal data, and does not have a range of dryness satisfying the demand of the user when the automatic dryness detection is not exactly carried out.

FIG. 6 illustrates a graph showing a range of dryness according to weights at each drying mode when the fixed dryness determination value (Δ) is used.

In FIG. 6, it indicates that drying is performed exactly when there are points represented as 1, 2, and 3 (1→1.0 kg, 2→2.0 kg, 3→4.5 kg) that are divided according to the weight in a block (a part indicated by a straight perpendicular line) at each corresponding drying mode respectively. However, when the points are displayed outside of the block, it indicates that drying is not exactly performed.

It is dryness having a level of y axis for a corresponding point, showing that the fixed dryness detection value (Δ) is detected at each point of 1, 2, and 3.

As illustrated in FIG. 6, in case of a small amount of laundry, desired dryness is achieved in each drying course, that is Dry, Strong, Damp, and LTD (Low Temperature Dry) when the drying operation is performed by using the fixed dryness determination value (Δ). However, dryness is lower with a larger amount of laundry.

DISCLOSURE OF INVENTION

An object of the present invention, provided to solve the foregoing problem of an automatic drying method of a conventional automatic dry washer and dryer, is to provide an automatic dry control method for enabling exact dry by stabilizing a detection value of a temperature sensor at an automatic dry washer and drum type dryer determining dryness by using the temperature sensor, and performing an additional drying operation according to the point of achieving the first dryness.

To achieve these objects and other advantages and in accordance with the purpose of the invention, as embodied and broadly described herein, the automatic dry control method includes a method for determining dryness by using temperature sensors that detects temperature being changed according to a progress of a drying operation, method for determining dryness by using temperature sensors including the steps of continuously calculating temperature difference value (ΔT) between the temperature sensors and storing the difference; setting a calculation section to be consistent with an ending point of a rotation period of a motor for operating the drum and calculating section average value (AvgΔT) of the temperature difference value (ΔT) stored for the corresponding section; and ending the drying operation when the calculated section average value (AvgΔT) is a desired dryness determination value (Δ).

In this case, the calculation section for calculating the section average value (AvgΔT) is consistent with a section wherein the motor rotation period is repeated n times. It is desirable that the calculation section for calculating the section average value (AvgΔT) is consistent with a section wherein the motor rotation period repeats two times.

The temperature difference values (ΔT) are calculated by difference of detection temperature values from a duct temperature sensor (TA1) located at a duct including a circulating passage for drying and from a tub temperature sensor (Ttub) located at a tub for detecting temperature being changed in the process of drying.

The temperature difference values (ΔT) are calculated by difference of detection temperature values from a first temperature sensor (TA1) located at an upper end of a duct including a circulating passage for drying, and from a second temperature sensor (TA2) located at a lower end of the duct for detecting temperature being changed in the process of drying.

In another aspect of the present invention, an automatic dry control method for determining dryness by using temperature sensors that detect temperature being changed in the process of drying, including the steps of: calculating and storing continuously temperature difference value (ΔT) between the temperature sensors; setting a calculation section to be consistent with a point of ending a motor rotation period for driving a drum, and calculating a section average value (AvgΔT) of the temperature difference values stored during a corresponding section; amplifying the calculated section average value (AvgΔT) so as to be understood at a micro computer by subdividing; and ending drying operation when the amplified section average value is a desired dryness determination value (Δ).

In another aspect of the present invention, an automatic dry control method for determining dryness by using temperature sensors that detects temperature being changed in the process of drying, including the steps of: calculating and storing continuously temperature difference value (ΔT) between the temperature sensors; calculating a section average value (AvgΔT) of the temperature difference values (ΔT) stored for a corresponding section at a point when a motor rotation period for driving a drum is ended; and determining an additional drying time on a basis of a required drying time till now when the calculated section average value (AvgΔT) is a desired dryness determination value (Δ).

In this case, the additional drying time is linearly increased in proportion to a required drying time till the dryness determination value (Δ) is satisfied, and the additional drying is not performed when the drying time required till the dryness determination value (Δ) is satisfied is within a standard time.

The standard time for not performing the additional drying is different according to a drying mode.

It is judged as that the dryness is achieved when a case of satisfying the calculated section average value (AvgΔT) is more than two times, and the additional drying time is determined.

BRIEF DESCRIPTION OF DRAWINGS

The accompanying drawings, which are included to provide a further understanding of the invention, illustrate embodiment(s) of the invention and together with the description serve to explain the principle of the invention. In the drawings.

BEST MODE FOR CARRYING OUT THE INVENTION

Reference will now be made in detail to the preferred embodiments of the present invention, examples of which are illustrated in the accompanying drawings. In describing the embodiments, parts the same with the related art fuel cell will be given the same names and reference symbols, and detailed description of which will be omitted.

Figure 1:
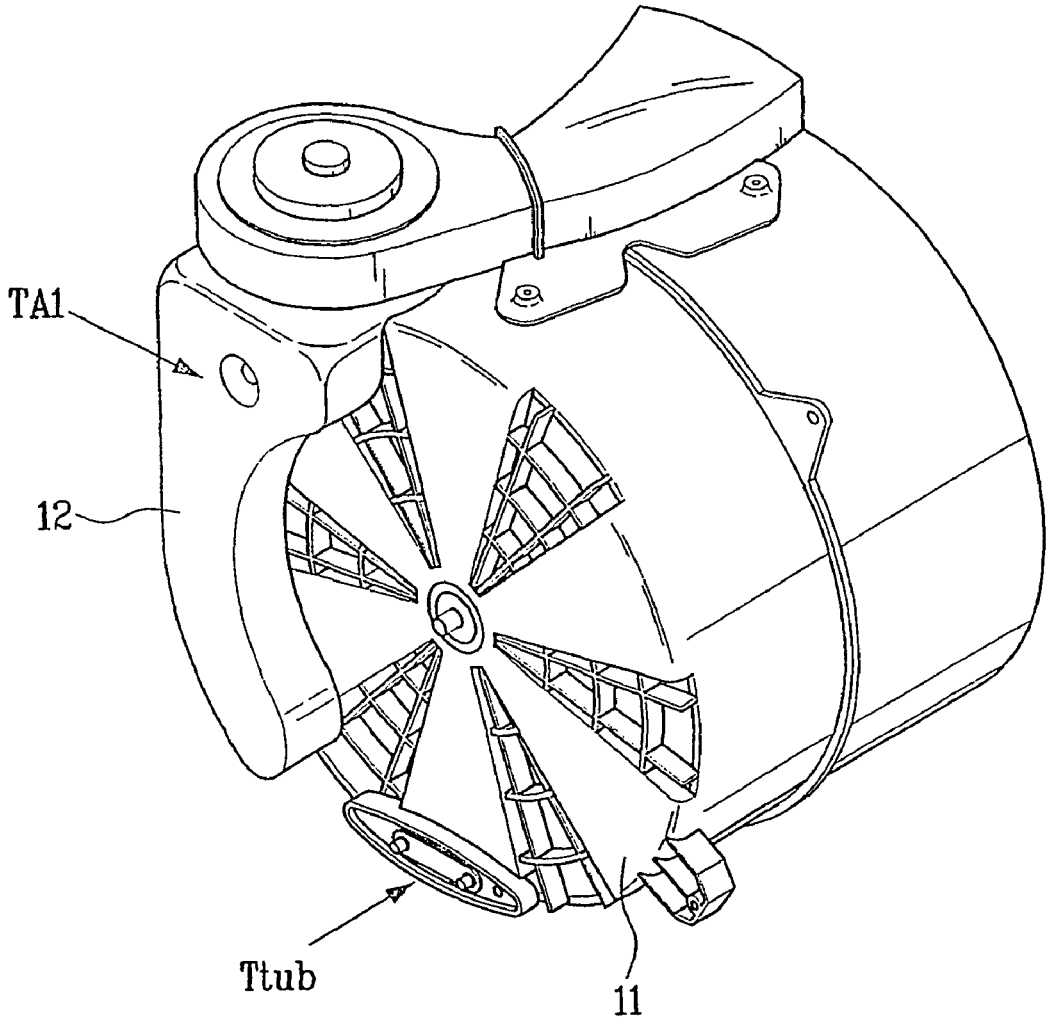
FIG. 1 illustrates a structural view showing an example of a temperature sensor location used for determining dryness in an automatic dry washer.
Figure 2:
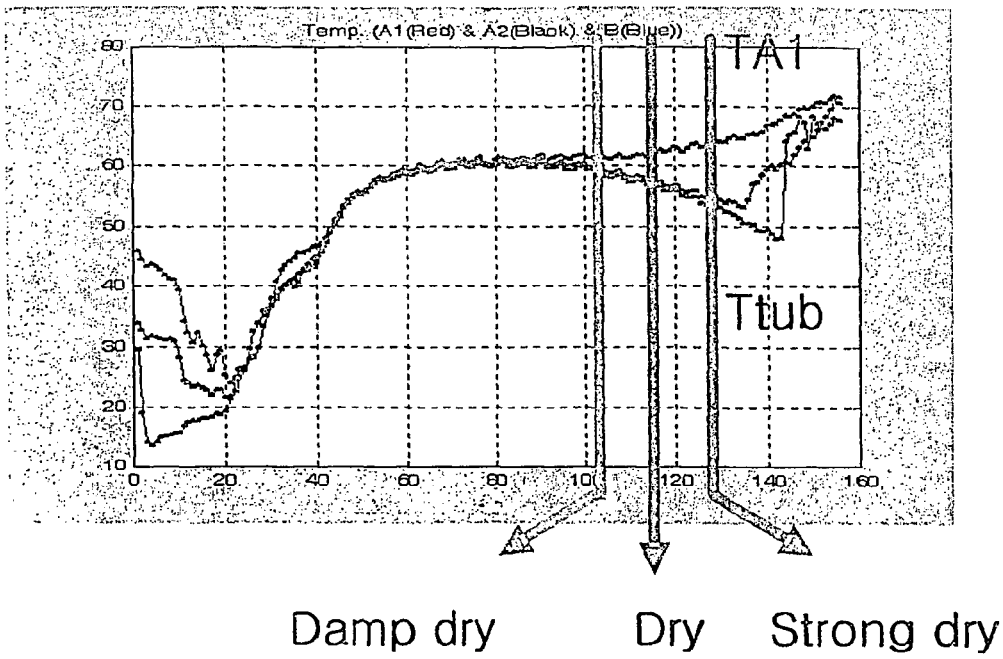
FIG. 2 illustrates a graph showing a temperature change between a duct temperature sensor and a tub temperature sensor according to a drying process.
Figure 3:
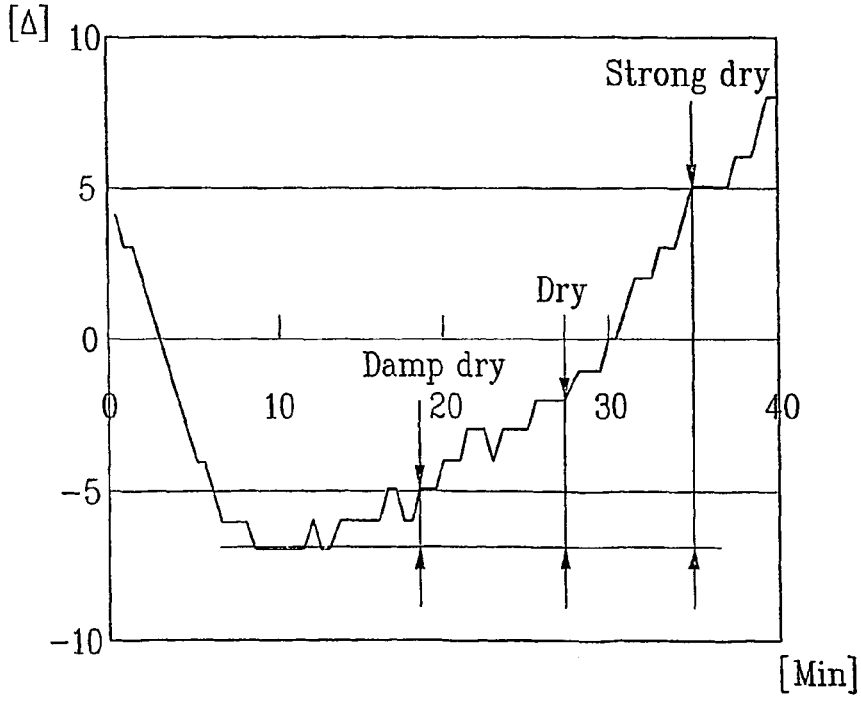
FIG. 3 illustrates a graph showing a change of temperature difference value(ΔT) between a duct temperature sensor and a tub temperature sensor according to a drying process.
Figure 4A:
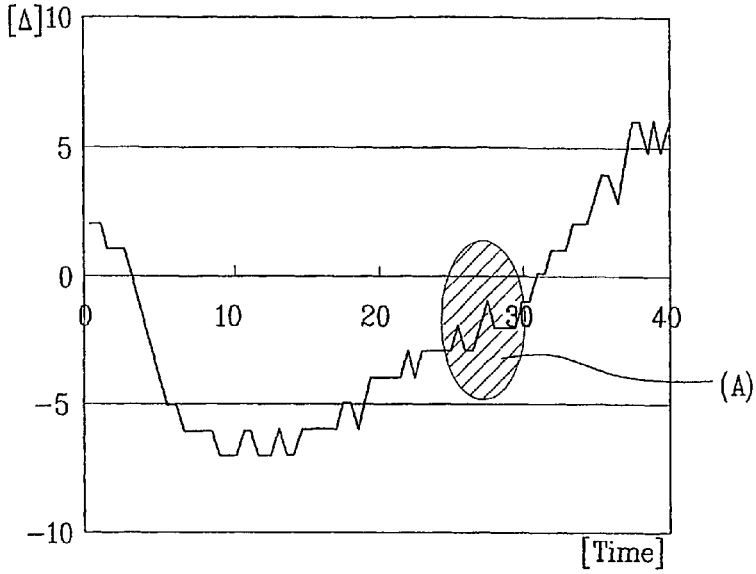
FIGS. 4*a* and 4*b* illustrate a graph showing a change of the temperature difference value (ΔT) of the duct temperature sensor and the tub temperature sensor, and a relationship between the motor period (CW_CCW) and the temperature data.
Figure 4B:
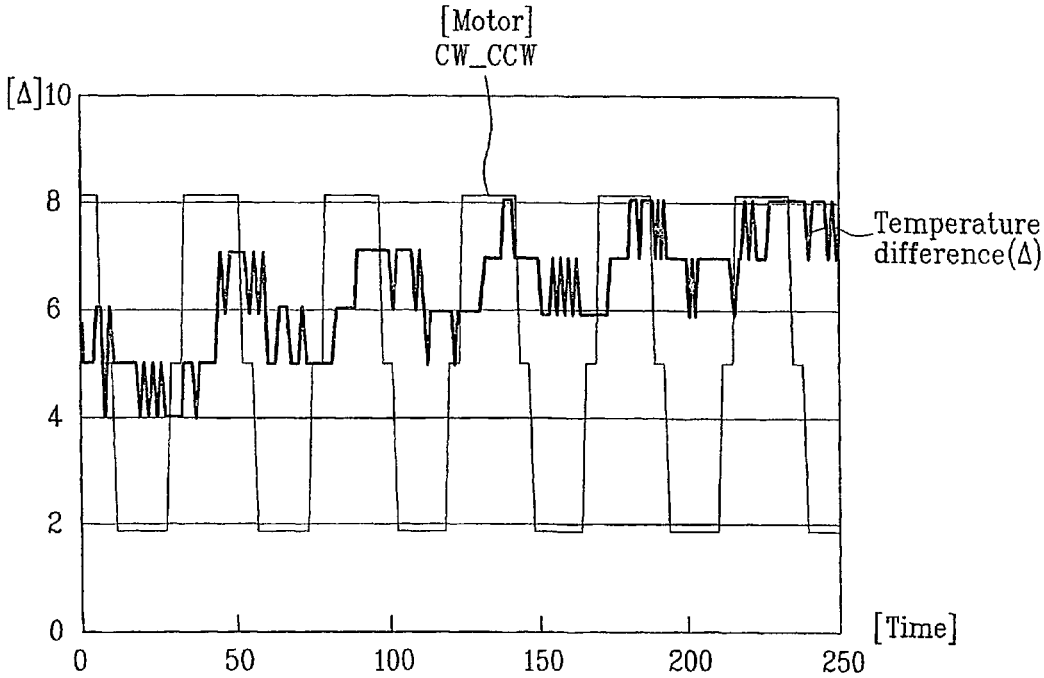
Figure 5:
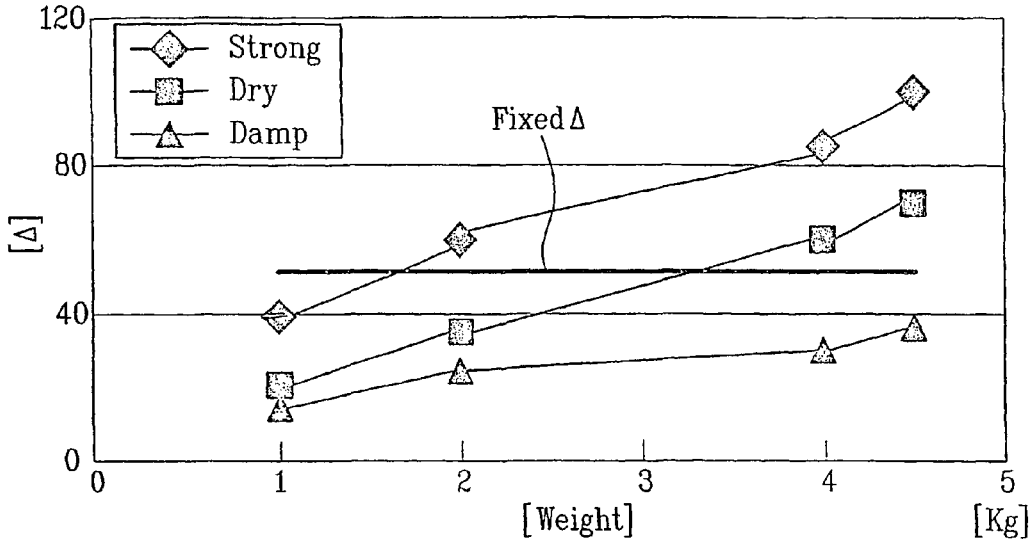
FIG. 5 illustrates a graph showing a change of dryness determination value (Δ) at a point of achieving desired dryness according to weight.
Figure 6:
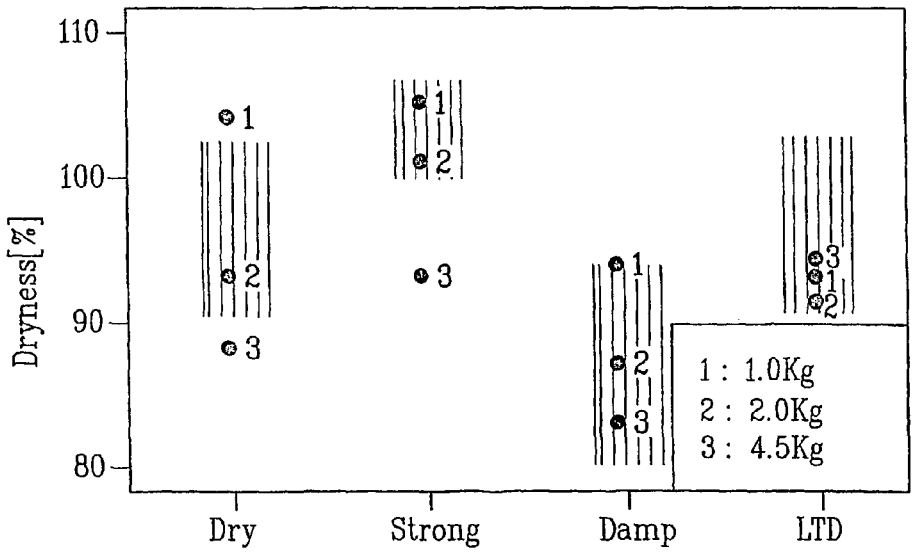
FIG. 6 illustrates a graph showing a range of dryness according to weights at each drying mode when a fixed dryness determination value (Δ) is used.
Figure 7A:
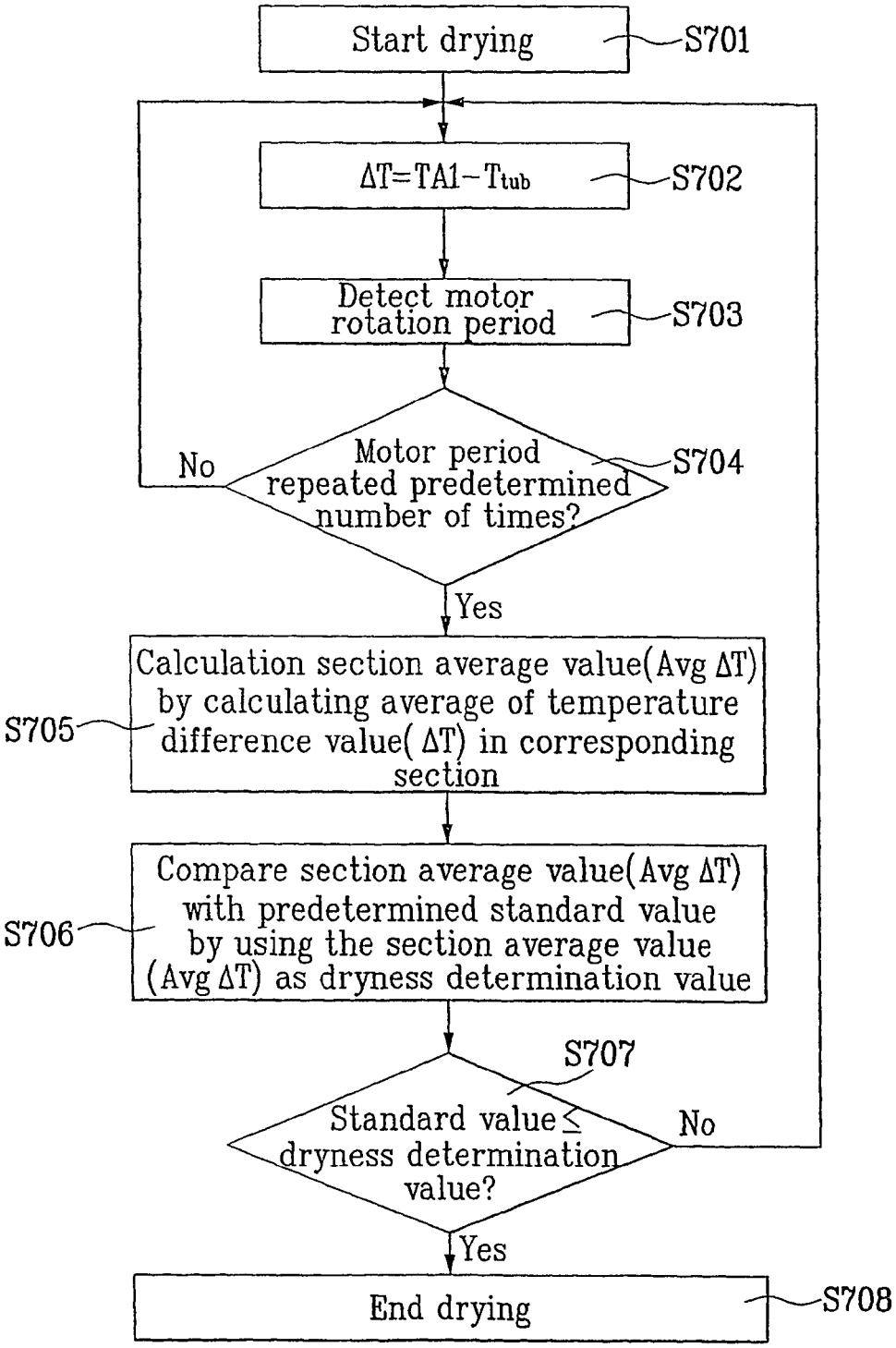
FIGS. 7*a* to 7*c* illustrate a flow chart showing an automatic dry control method in accordance with 1, 2, and 3 embodiments of the present invention.
Figure 7B:
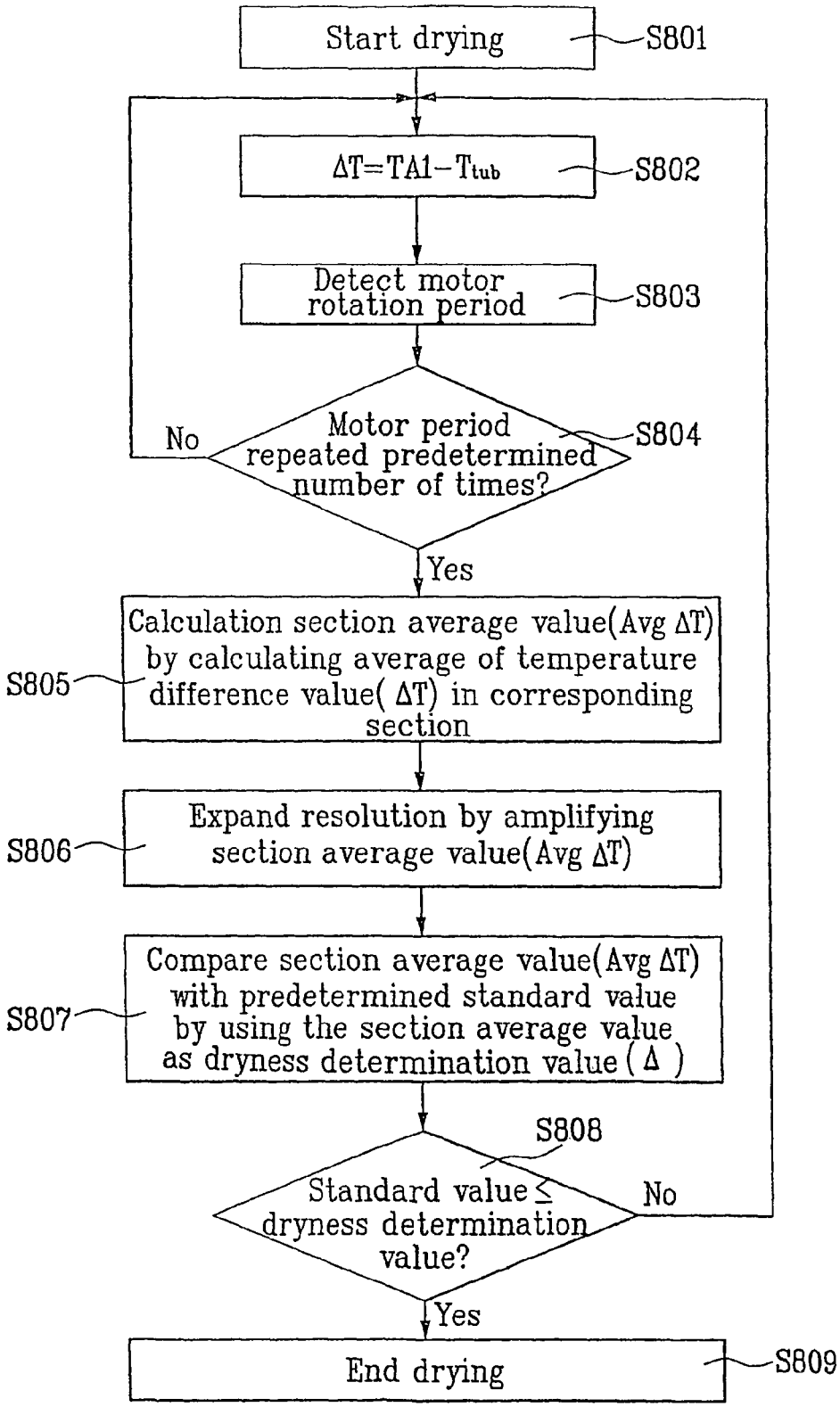
Figure 7C:
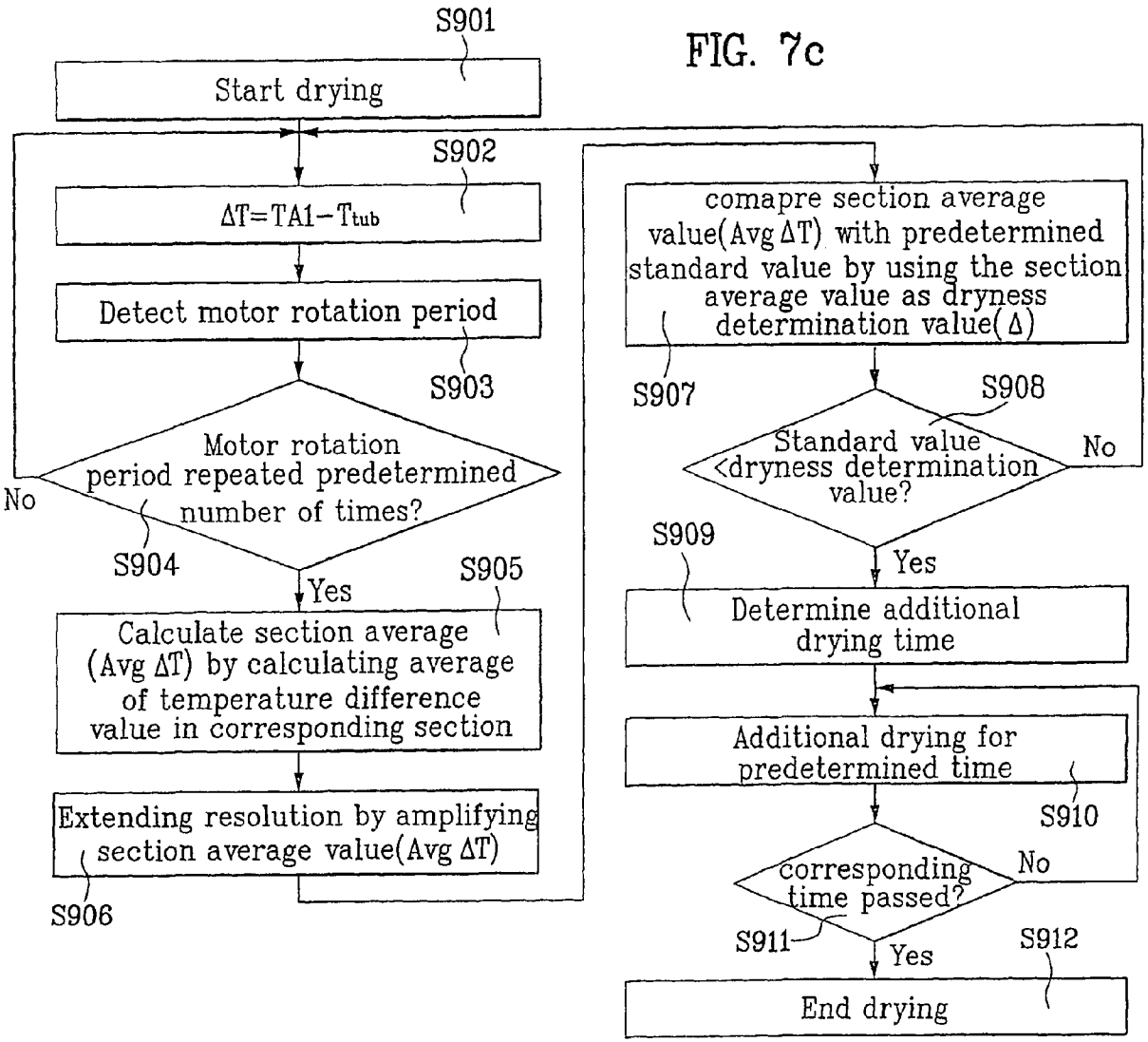

FIGS. 7*a* to 7*c* illustrate a flow chart showing an automatic dry control method in accordance with 1, 2, and 3 embodiments of the present invention.

The automatic dry control method in accordance with the present invention is divided into the steps of stabilizing temperature data, extending resolution by amplifying the stabilized temperature data, calculating an additional drying time on the basis of a time elapsed till a point of detecting the dryness determination value (Δ) according to the drying mode, and performing the additional drying operation.

Hereinafter, the weight means a weight with due regard to a percentage of water contained, and particularly, with due regard to not only just a simple weight but also quality (the percentage of water contained changes according to the quality).

Hereinafter, 'ΔT' means a temperature difference value between the temperature sensors before calculating the average value in a corresponding section, 'AvgΔT' means a section average value calculated in the corresponding section, and 'Δ' means a final determination value calculated through the stabilizing step.

The temperature difference values (ΔT) is calculated by a difference between a detection temperature value of the duct temperature sensor (TA1) being provided at the duct including a circulating passage for drying, and a detection temperature value of the tub temperature sensor (Ttub) provided at the tub for detecting a temperature change according to a progress of drying operation.

As another method, the temperature difference values (ΔT) may be calculated by a difference between a detection temperature value of a first temperature sensor (TA1) being provided at an upper end portion of the duct including a circulating passage for drying, and a detection temperature value of a second temperature sensor (TA2) provided at a lower end portion of the duct for detecting a temperature change according to the progress of drying operation.

Hereinafter, use of the duct temperature sensor (TA1) and the tub temperature sensor (Ttub) will be described.

In the automatic dry control method in accordance with a first embodiment of the present invention, when the drying operation started (S701), a micro computer calculates periodically the temperature difference value (ΔT) from a point when the detection temperature of the tub temperature sensor (Ttub) is changed more than a predetermined amount, or when a predetermined time is passed after the drying operation is started (ΔT=TA1−Ttub).

Desirably, a system is applied for revising the temperature data from the point when the detection of the temperature sensor is stabilized (a coolant supplying point for drying) after the drying operation is started, and calculating the dryness determination value (Δ).

When a programmed motor rotation period (T) is detected (S703) and the motor rotation period is repeated for a predetermined times (S704), the section average value (AvgΔT) of the temperature difference values (ΔT) is calculated (S705), the temperature difference values (ΔT) detected in the corresponding section, calculated by using the temperature data of the duct temperature sensor (TA1) and the tub temperature sensor (Ttub), and stored.

Averaging the section average value (AvgΔT) in the micro computer at a point when the motor rotation period ends minimizes an influence of the first and second rotation periods of the motor upon the temperature data value.

Figure 8:
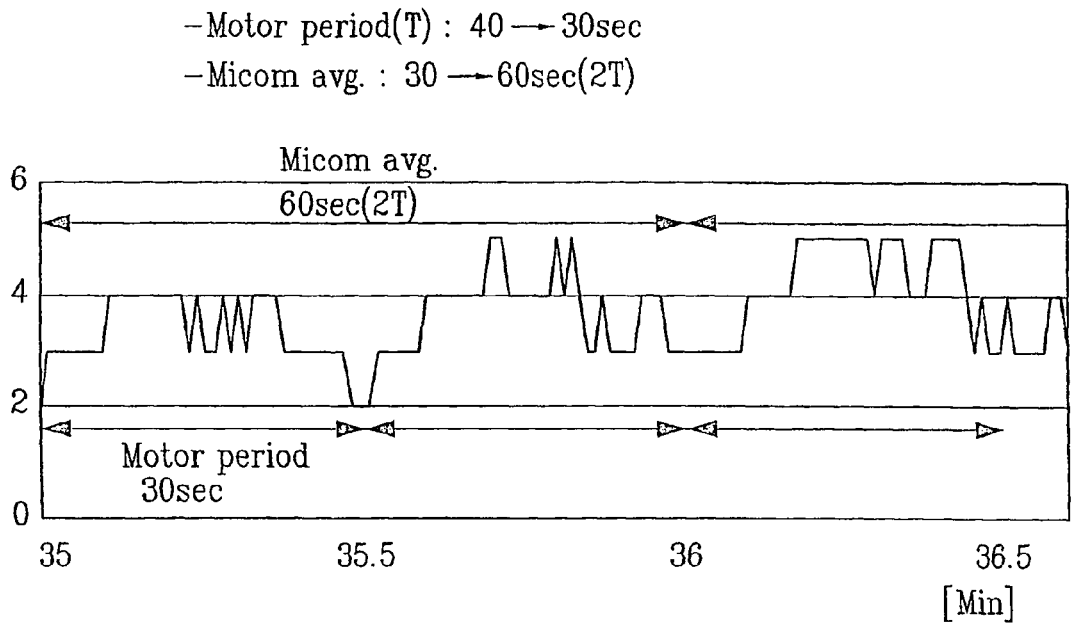
FIG. 8 illustrates a graph showing a relationship between an average value calculating period and a motor period for calculating a dryness determination value (Δ) in accordance with the present invention.

FIG. 8 illustrates a graph showing a relationship between an average value calculating period and a motor period for calculating a dryness determination value (Δ) in accordance with the present invention.

As an embodiment or example, a set of one motor rotation period of 40 sec including rotation in the first direction for 16 sec—stop for 4 sec—rotation in the second direction for 16 sec—stop for 4 sec) is changed into another set of one motor rotation period pf 30 sec (including rotation in the first direction for 12 sec—stop for 3 sec—rotation in the second direction for 12 sec—stop for 3 sec).

When a period for calculating the section average value (AvgΔT) is 60 sec, the section average value (AvgΔT) is calculated at every other rotation period, and data stability is increased by calculating one section average value (AvgΔT) based on the every other motor rotation period.

Figure 9:
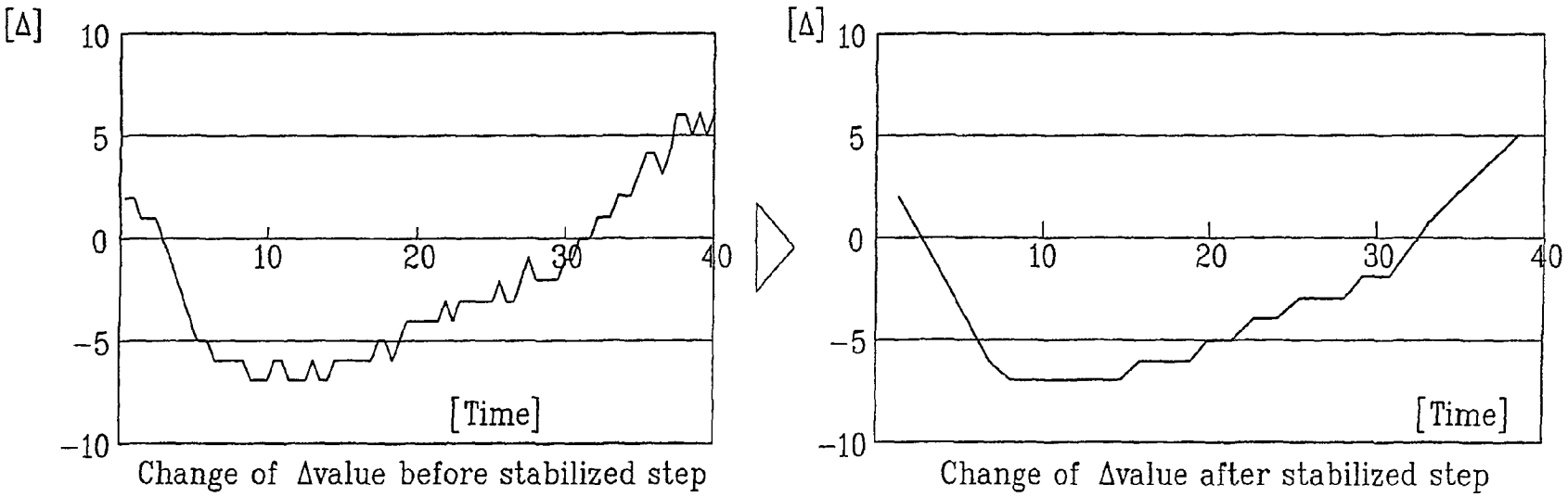
FIG. 9 illustrates a graph showing a change of a dryness determination value (Δ) from which data vibration is removed by performing a step of stabilizing in accordance with the present invention.

In case that the section average value (AvgΔT) is calculated and used as the dryness determination value (Δ), a shaking phenomenon is undermined and stabilized as illustrated in FIG. 9.

FIG. 9 illustrates one example that the data is stabilized by setting a motor rotation period (other than 30 sec) different and making the calculation period of the section average value (AvgΔT) to be consistent with the motor rotation period in the micro computer.

FIG. 9 illustrates a graph showing a change of a dryness determination value (Δ) from which data vibration is removed by performing a step of stabilizing in accordance with the present invention.

The section average value (AvgΔT) is used as the dryness determination value (Δ) and compared with a standard value set according to a corresponding dryness mode (S706).

As a result of the comparison (S707), if the section average value does not satisfy a selected dryness mode, the temperature difference value (ΔT) of the detection temperatures of the duct temperature sensor (TA1) and the tub temperature sensor (Ttub)is calculated in the micro computer (ΔT=TA1−Ttub) and stored (S702), and the aforementioned step is repeated.

If the section average value satisfies the selected drying mode in the comparison step, the drying operation is stopped (S708). In this case, when it is detected two times that the standard value is less than the dryness determination value (Δ) at the step of using the section average value (AvgΔT) as the dryness determination value (Δ) and comparing the value with the standard value set according to a corresponding drying mode, it is regarded as that the desired dryness is achieved. It is to increase exactness of the dryness determination.

The automatic dry control method in accordance with a first embodiment of the present invention removes inaccuracy resulted from the vibration of the temperature data by calculating the section average value (AvgΔT) of the corresponding section with due regard to the motor rotation period and using the section average value as the dryness determination value (Δ), and enables an automatic dry control satisfying enough the demand of the user by subdividing the dryness value so as to understand exactly in the micro computer.

The automatic dry control method in accordance with the present invention includes an amplifying step for increasing resolution of the determination value for determining dryness.

First of all, as illustrated in FIG. 7B, when the drying operation started (S801), the temperature difference value (ΔT) is calculated periodically from a point when the detection temperature of the tub temperature sensor (Ttub) is changed more than a predetermined amount, or when a predetermined time is passed after the drying operation is started (ΔT=TA1−Ttub) (S802).

(When the motor rotation period (T), which is programmed, is detected (S803) and repeated as much as a predetermined times (S804), the section average value (AvgΔT) of the temperature difference value calculated by using the temperature data of the duct temperature sensor (TA1) and the tub temperature sensor (Ttub) detected in the corresponding section, and stored for a period of the corresponding section (S805).

Averaging the section average value (AvgΔT) in the micro computer at a point when the motor rotation period ends is for minimizing an influence of the first and second rotation period of the motor upon the temperature data value.

And, a step for calculating the dryness determination value (Δ) is performed by amplifying the section average value (AvgΔT) being calculated for increasing the dryness determination resolution (S806).

In this case, the amplified section average value (AvgΔT) is, of course, a value calculated in the calculation section corresponding to a section that the motor rotation period is repeated n times.

For example, when 30 sec is one motor rotation period, the calculation section is set to 60 sec, and an average value of the temperature difference values (ΔT) stored for 60 sec continuously is calculated and amplified.

When the temperature is amplified, inaccuracy of the data becomes larger in the related art because the vibration of the temperature data is large. However, in the present invention, the data is in a stabilized state, therefore, amplification of the data becomes available and the resolution of the data is increased, thereby securing reliability.

In the micro computer, for example, when 1-5V output is understood as 8 bit values, the output is divided into 1-255 and understood, and the dryness determination value (Δ) '5' and '5.9' are both understood as '5'.

TABLE 1

| | ADC Decimal | When amplified 4 times | When amplified three times |
|---|---|---|---|
| Damp | Δ5 | Δ20 | Δ15 |
| Dry | Δ8 | Δ35 | Δ25 |
| Strong | Δ13 | Δ50 | Δ40 |

However, as illustrate in Table 1, when the dryness determination value (Δ) is amplified, the dryness more precisely determined with subdivided stages because, in the micro computer, the value is divided to be understood, for example, into '20' if 5.00-5.24 is amplified four times, '22' if 5.50-5.74 is amplified four times, and '23' if 5.75-5.99 is amplified four times.

The amplified section average value is calculated by multiplying the section in the form of ADC decimal data by m, and in this case, the number of the value understood in the micro computer is increased m times.

And, the dryness determination value (Δ) calculated as abovementioned is compared to the standard value set according to the corresponding drying mode (S807).

As a result of the comparison (S808), if the dryness determination value does not satisfy the selected drying mode, the temperature difference value (ΔT) of the detection temperature of the tub temperature sensor (TA1) and the tub temperature sensor (Ttub) is calculated in the micro computer (ΔT=TA1−Ttub) and stored (S802), and then the aforementioned step is repeated.

If the dryness determination value ? satisfies the selected drying mode in the comparison step, the drying operation is ended (S809).

In the step of comparing the section average value (AvgΔT) is used as the dryness determination value (Δ) and compared with the standard value set according to the corresponding drying mode, when it is detected two times that the standard value is larger than the dryness determination value (Δ) at the step of using the section average value (AvgΔT) as the dryness determination value (Δ) and comparing the value with the standard value set according to the corresponding drying mode, it is regarded as that the desired dryness is achieved. It is to increase exactness of the dryness determination.

The automatic dry control method in accordance with a second embodiment of the present invention removes inaccuracy resulted from the vibration of the temperature data by calculating the section average value (AvgΔT) of the corresponding section with due regard to the motor rotation period and using the section average value as the dryness determination value (Δ), and enables an automatic dry control satisfying enough the demand of the user by subdividing the dryness value so as to understand exactly in the micro computer.

The automatic dry control method in accordance with a third embodiment of the present invention performs an additional dry operation based on the time required for achieving a first dryness achieving point set on the basis of the dryness determination value at a dry starting point so as to satisfy the corresponding drying mode for all weights.

First of all, as illustrated in FIG. 7*c*, when the drying operation started (S901), the temperature difference value (ΔT) is calculated periodically from a point when the detection temperature of the tub temperature sensor (Ttub) is changed more than a predetermined amount, or when a predetermined time is passed after the drying operation is started (ΔT=TA1−Ttub) (S902).

When the motor rotation period (T), which is programmed, is detected (S903) and repeated as much as a predetermined times (S904), the section average value (AvgΔT) of the temperature difference value calculated by using the temperature data of the duct temperature sensor (TA1) and the tub temperature sensor (Ttub) detected in the corresponding section, and stored for a period of the corresponding section (S905).

Averaging the section average value (AvgΔT) in the micro computer at a point when the motor rotation period ends is for minimizing an influence of the first and second rotation period of the motor upon the temperature data value.

And, a step for calculating the dryness determination value (Δ) is performed by amplifying the section average value (AvgΔT) being calculated for increasing the dryness determination resolution (S906).

When the temperature is amplified, inaccuracy of the data becomes larger in the related art because the vibration of the temperature data is large. However, as in the present invention, when the data is stabilized and amplified, the resolution of the data is increased, thereby securing reliability.

And, the dryness determination value (Δ) calculated as abovementioned is compared to the standard value set according to the corresponding drying mode (S907).

As a result of the comparison (S908), if the dryness determination value does not satisfy the selected drying mode, the temperature difference value (ΔT) of the detection temperature of the tub temperature sensor (TA1) and the tub temperature sensor (Ttub) is calculated in the micro computer (ΔT=TA1−Ttub) and stored (S902), and then the aforementioned step is repeated.

If the dryness determination value satisfies the selected drying mode in the comparison step, the drying operation is performed (S909) on the basis of the time required from the dry starting point to the present.

Figure 10:
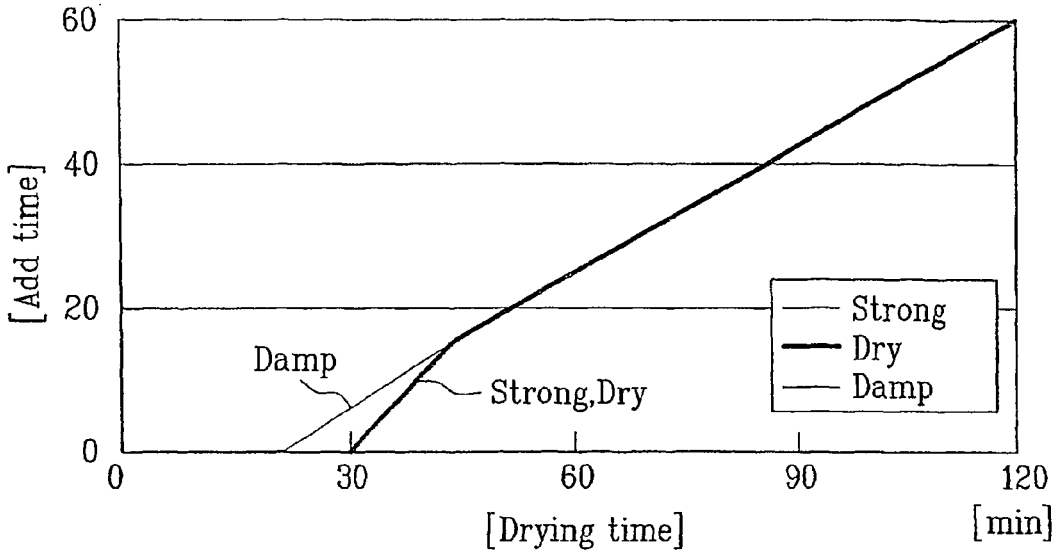
FIG. 10 illustrates a graph showing a relationship between a required time till a first dryness achieving point and an additional time.
Figure 11:
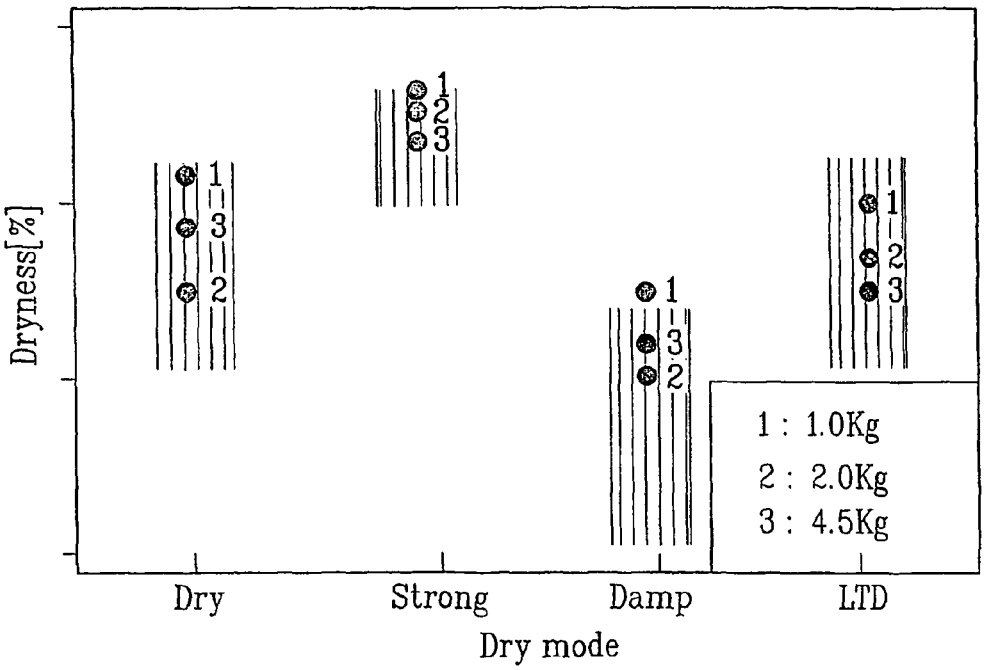
FIG. 11 illustrates a graph showing a dryness distribution according to weights at each drying mode when a drying process is performed by using a dryness determination value (Δ) fixed by the present invention.

Determination of the additional drying time is described in detail as follows. FIG. 10 illustrates a graph showing a relationship between required time till a point of achieving a first dryness and an additional drying time, and FIG. 11 illustrates a graph showing a dryness range according to weight at each drying mode when a drying operation is performed by means of a dryness determination value (Δ) fixed by the present invention.

Based on the time required for achieving the first dryness, a value of the additional drying time is determined linearly as illustrated in FIG. 10 because the dryness in the corresponding section is jumped and it is difficult to achieve the dryness exactly when the additional drying time is nonlinear on the basis of the time required but has steps. The reason why the additional dry operation is performed after the first dryness achieved by using the fixed dryness determination value (Δ) is as follows. It is difficult to set the dryness determination value (Δ) for enabling to determine the dryness uniformly for all weights during automatic drying process.

The point of achieving 90% of dryness is different for each weight. The fact that the point of achieving 90% of dryness in the same drying mode is different for each weight means that the dryness determination value (Δ) is different.

Therefore, when the dry operation is performed by using the fixed dryness determination value (Δ) and the dryness determination value (Δ) is satisfied, the dryness is lowered as much as the increase of the weight.

As illustrated in FIG. 11, when the additional drying time is determined, for example when the point of satisfying the dryness determination value (Δ) is a point 60 min passed from the dry starting point, the additional drying time becomes 25 min.

In other words, according to the increase of the time required for achieving the first dryness of X axis, the additional drying time of Y axis is linearly increased.

The X axis means a drying time till the point of satisfying the dryness determination value, and the Y axis means an additional drying time when a graph line is corresponding to one value of the x axis.

The reason why the additional drying time is increased in proportion to the time required for achieving the first dryness is because the time required for reaching the fixed dryness determination value (Δ) is different according to the quality even when the weight is the same.

For example, when the laundry is made of a material that is easily dried, the time for reaching the fixed dryness determination value (Δ) is short. Accordingly, the additional drying time is shortened so as to achieve exact dryness the user desired.

In contrast, when the laundry is made of a material uneasily dried, the time for reaching the fixed dryness determination value (Δ) is long. Accordingly, the additional drying time is elongated so as to achieve exact dryness the user desired.

When the additional drying time is determined on the basis of the same standard exampled in FIG. 10, the additional drying time drying is performed for the determined time (S910). When the additional drying is performed and the corresponding time is passed (S911), the whole drying process is ended (S912).

In this case, there is a section becoming the desired dryness without the additional drying, it is when the time for reaching the fixed dryness determination value (Δ) is short.

When the time is set as a standard time, and when the time for reaching the fixed dryness determination value (6) is shorter than the standard time, the additional drying is not performed.

In other words, at the 'Damp' mode, when the time for reaching the fixed dryness determination value (Δ) is less than 20 min, the additional drying is not performed. At a 'Strong' drying mode, and at a 'Dry' drying mode, when the time for reaching the fixed dryness determination value (Δ) is less than 30 min, the additional drying is not performed.

As aforementioned, the reason why the additional drying is not performed is for optimizing the dryness at the state of ending the total dry operation in due regard to the quality and the percentage of water contained.

As illustrated in FIG. 11, all the points are located, the points represented as 1, 2, and 3 divided according to weight in a block (a part indicated by a straight perpendicular line) at each corresponding drying mode respectively.

The first dryness is determined by using the fixed dryness determination value, and it means that exact drying is enabled for all weights by performing the additional drying according to the result.

In other words, the dryness desired at each mode (Dry, Strong, Damp, LTD (Low Temperature Dry)) is obtained for all weights without dividing the laundry into a small amount and a large amount.

While the drying is performed by the control method in accordance with the first, second, and third embodiments of the present invention above mentioned, if a drying time becomes a limited drying time (230 min), or one of the detection temperature value becomes over the drying limit value, for example, 180 (ADC decimal data), the drying operation is ended regardless of the dryness for safety.

Accuracy of the drying operation is increased by stabilizing the temperature data for determining dryness in the automatic drying washer and the drum type washer, extending resolution by amplification, and determining additional drying time for enabling exact drying for all weights.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

Industrial Applicability

As aforementioned, the automatic dry control method in accordance with the present invention has effects as follows.

First, inaccuracy resulted from the vibration of the temperature data is removed and an automatic dry control is enabled for satisfying a demand of the user by calculating the section average value (AvgΔT) of corresponding section with due regard to the motor rotation period correlated with vibration of the temperature data, and using the section average value as a dryness determination value (Δ).

Second, an automatic dry control method is enabled for satisfying the demand of the user enough by subdividing exactly the dryness determination value in the micro computer and amplifying to understand.

Third, a first dryness is determined by using a fixed dryness determination value and additional drying is performed according to a result thereof so as to enable exact drying for all weights.

What is claimed is:

1. An automatic dry control method for determining dryness using a plurality of temperature sensors that detects a change in temperature a process of drying in a dryer that comprises a drum periodically rotated by a motor during the process of drying, the motor rotating back and forth in a motor rotation period, the automatic dry control method comprising:

calculating and storing continuously a temperature difference value (ΔT) between temperatures sensed by the plurality of temperature sensors;

setting a calculation section to correspond to the motor rotation period for driving the drum, and calculating a section average value (AvgΔT) of a plurality of temperature difference values (ΔT) stored during the calculation section; and ending a drying operation when the calculated section average value (AvgΔT) is a predetermined dryness determination value (Δ).

2. The automatic dry control method of claim 1, wherein the calculation section for calculating the section average value (AvgΔT) is consistent with a section during which the motor rotation period is repeated a predetermined number of times.

3. The automatic dry control method of claim 2, wherein the calculation section for calculating the section average value (AvgΔT) is consistent with a section during which the motor rotation period is repeated two times.

4. The automatic dry control method of claim 1, wherein the temperature difference value (ΔT) is calculated by using a difference in detected temperature values from a duct temperature sensor (TA1) located in a duct including a circulating passage for drying and from a tub temperature sensor (Ttub) located in a tub of the dryer, that detect the change in temperature in the process of drying.

5. The automatic dry control method of claim 1, wherein the temperature difference value (ΔT) is calculated using a difference in detected temperature values from a first temperature sensor (TA1) located at an upper end of a duct including a circulating passage for drying and from a second temperature sensor (TA2) located at a lower end of the duct, that detect the change in temperature in the process of drying.

6. The automatic dry control method of claim 1, wherein the dryness determination value (Δ) is calculated using the temperature difference value (ΔT) from a point of coolant supply for drying after drying is started.

7. The automatic dry control method of claim 1, wherein the temperature difference value (ΔT) between the plurality of temperature sensors is calculated and the calculating the section average value (AvgΔT) thereof is repeated when a dryness determination value (Δ) determined in a dryness determination is not the predetermined dryness determination value.

8. An automatic dry control method for determining dryness using a plurality of temperature sensors that detects a change in temperature in a process of drying in a dryer that comprises a drum periodically rotated by a motor during the process of drying, the motor rotating back and forth in a motor rotation period, the automatic dry control method comprising:

calculating and storing continuously a temperature difference value (ΔT) between temperatures sensed by the plurality of temperature sensors;

setting a calculation section to correspond to a motor rotation period for driving the drum, and calculating a section average value (AvgΔT) of the temperature difference values stored during the calculation section;

amplifying the calculated section average value (AvgΔT) so as to be understood at a micro computer by subdividing; and ending drying operation when the amplified section average value is a predetermined dryness determination value (Δ).

9. The automatic dry control method of claim 8, wherein the calculation section for calculating the section average value (AvgΔT) for amplifying is consistent with a section during which the motor rotation period is repeated a predetermined number of times.

10. The automatic dry control method of claim 9, wherein the calculation section is set at 60 sec when the motor rotation period is 30 sec, and an average of the ΔT values stored continuously for 60 sec is calculated and amplified.

11. The automatic dry control method of claim 9, wherein the amplified section average value is calculated by multiplying the section average value (AvgΔT) by m, and the number of the value in the micro computer is increased m times.

12. An automatic dry control method for determining a dryness using a plurality of temperature sensors that detects a change in temperature in a process of drying in a dryer that comprises a drum periodically rotated by a motor during the process of drying, the motor rotating back and forth in a motor rotation period, the automatic dry control method comprising:

calculating and storing continuously a temperature difference value (ΔT) between temperatures sensed by the plurality of temperature sensors;

calculating a section average value (AvgΔT) of a plurality of temperature difference values (ΔT) stored for a corresponding section, at a point when the motor rotation period for driving the drum is ended; and determining an additional drying time on a basis of a predetermined drying time when the calculated section average value (AvgΔT) is a predetermined dryness determination value (Δ).

13. The automatic dry control method of claim 12, wherein a calculation section for calculating the section average value (AvgΔT) is consistent with a section during which the motor rotation period is repeated a predetermined number of times.

14. The automatic dry control method of claim 12, wherein the additional drying time is linearly increased in proportion to the predetermined drying time until the dryness determination value (Δ) is satisfied.

15. The automatic dry control method of claim 14, wherein the additional drying is not performed when the predetermined drying time is within a standard time.

16. The automatic dry control method of claim 15, wherein the standard time is different according to a drying mode.

17. The automatic dry control method of claim 12, wherein it is judged that dryness is achieved when the calculated section average value (AvgΔT) is more than two times, and the additional drying time is determined.

18. The automatic dry control method of claim 12, wherein the drying operation is ended when a drying operation time reaches a drying limit time, or when at least one of the detected temperature values of the plurality of temperature sensors reaches a dryness limit value.

* * * * *